US005244356A

United States Patent [19]

Hasegawa

[11] Patent Number: 5,244,356

[45] Date of Patent: Sep. 14, 1993

[54] HYDRAULIC PISTON APPARATUS

[75] Inventor: Hisao Hasegawa, Tokyo, Japan

[73] Assignee: Daiichi Electric Kabushiki Kaisha, Fujisawa, Japan

[21] Appl. No.: 969,515

[22] Filed: Oct. 30, 1992

Related U.S. Application Data

[63] Continuation of Ser. No. 527,728, May 23, 1990, abandoned.

[51] Int. Cl.[5] ..... F04B 1/04

[52] U.S. Cl. ..... 417/273; 417/462

[58] Field of Search ..... 417/462, 471, 273, 279, 417/221

[56] References Cited

U.S. PATENT DOCUMENTS

| | | | |
|---|---|---|---|
| 2,376,016 | 5/1945 | Schnell | 417/219 |
| 2,568,357 | 9/1951 | Moulden | 417/221 |
| 2,764,964 | 10/1956 | Meyer | 417/462 |
| 2,867,175 | 1/1959 | West | 417/221 |
| 3,067,693 | 12/1962 | Lambeck | 417/219 |
| 3,294,032 | 12/1966 | Sundblom | 417/462 |
| 3,790,307 | 2/1974 | Aldinger | 417/273 |
| 3,799,035 | 3/1974 | Lamm | 417/462 |
| 4,055,387 | 10/1977 | Potter | 417/219 |
| 4,200,072 | 4/1980 | Bailey | 417/462 |
| 4,419,054 | 12/1983 | Sosnowski | 417/219 |
| 4,652,215 | 3/1987 | Kuroyanagi et al. | 417/219 |
| 4,697,991 | 10/1987 | Tsukamara | 417/219 |
| 4,768,422 | 9/1988 | Swinney | 417/221 |
| 4,927,338 | 5/1990 | Ito | 417/462 |
| 4,936,111 | 6/1990 | Wilkinson | 417/462 |

FOREIGN PATENT DOCUMENTS

| | | | |
|---|---|---|---|
| 532926 | 8/1931 | Fed. Rep. of Germany | 417/221 |
| 2147687 | 9/1971 | Fed. Rep. of Germany | 417/462 |

*Primary Examiner*—Richard A. Bertsch
*Assistant Examiner*—Peter Korytnyk
*Attorney, Agent, or Firm*—Wenderoth Lind & Ponack

[57] ABSTRACT

A variable capacity hydraulic constant stroke piston apparatus has an annular rotor rotatably mounted for rotation around an axis of rotation and having a plurality of radial cylinder bores therein spaced at intervals therearound with working liquid inlets and outlets at the radially outer ends thereof, a rotor drive for rotating said rotor around the axis of rotation, an eccentric cam positioned within the rotor and movable along a circular locus of eccentric positions concentric with said axis of rotation; a device for fixing the eccentric cam at one of the plurality of eccentric positions and for moving the eccentric cam around the axis of rotation between said positions; a plurality of pistons radially reciprocally movably mounted in corresponding cylinder bores in the rotor, the pistons having heads normally contacting an outer periphery of the eccentric cam and moving through a constant length stroke at each position of the cam; and working liquid current rectifying means connected between the inlets and outlets of the cylinder bores and an inlet and outlet from the apparatus for supplying working liquid to the cylinders and receiving working liquid from the cylinders in a reciprocating flow and rectifying and smoothing the flow at the inlet and outlet of the apparatus. Alternatively the cam can be fixed and the stator movable through and fixable at one of the eccentric positions.

4 Claims, 9 Drawing Sheets

HYDRAULIC PISTON APPARATUS

This application is a continuation of application, Ser. No. 07/527,728, filed May 23, 1990, now abandoned.

BACKGROUND OF THE INVENTION

This invention is related, in a broad sense, to a hydraulic piston apparatus and particularly to a hydraulic pump and a hydraulic motor as a hydraulic piston apparatus.

More specifically, it relates, in its third and seventh embodiments, to a variable capacity hydraulic piston apparatus of a variable capacity type which is simple in structure and has a long service life.

The "piston" used herein is of the type for feeding and receiving a hydraulic pressure within a cylinder and in which its length (whether it is long or not) with respect to its diameter is not significant.

As for hydraulic pumps and motors, many proposals have heretofore been made. Some of the representative examples of such proposals are gear pumps, vane pumps, piston pumps, axial piston pumps and the like. As for variable capacity pumps among them, cam plate type piston pumps occupy a prominent position among pumps of the type which have a comparatively high discharge pressure as shown in FIG. 3.

The reason is that employment of pistons (plungers) 1, 1*a* make it easy to obtain a liquid confined pressure within cylinder chamber 2, 2*a* and the discharge quantity can be optionally established by changing the angle of a cam plate 3. Another reason is that management of accuracy of the outer diameters of the cylindrical pistons 1, 1*a* and the inner diameter of the cylinder is easy and manufacturing cost can also be reduced.

On the other hand, as is shown in FIG. 3, a linkage between the cam plate 3 and piston rods 4, 4*a*, and a service life of a connecting portion between an input rotational shaft 5 and the cam plate 3 have heretofore been considered to involve problems. Regarding the single body of the piston, current flow becomes an alternating flow owing to reciprocating motion. A method for sealing a current plate for converting the alternating current to an unidirectional direct current also becomes a big problem.

The axial pump cannot escape from this problem as long as it has the same construction.

SUMMARY OF THE INVENTION

It is therefore an object of the present invention to provide a hydraulic piston apparatus which is simple in structure and small in size, long in service life and low in manufacturing cost.

That is, in view of the above-mentioned problems, a hydraulic piston apparatus according to the present invention is designed such that a piston is actuated using an eccentric shaft.

Specific embodiments of a hydraulic piston apparatus according to the present invention will be described in detail.

The construction of a hydraulic piston apparatus of the first embodiment will be described first. According to this embodiment, first, there is an eccentric shaft. Second, there is a rotor. This rotor has the eccentric shaft eccentrically disposed therein. There are also a plurality of pistons. These pistons are radially disposed within the rotor and the heads of the pistons are normally contacted with the outer periphery of the eccentric shaft. Furthermore, there is working liquid current rectifying means. This working liquid current rectifying means is disposed in such a manner as to contact with a working liquid inlet and outlet port of the piston.

Next, the construction of a hydraulic piston apparatus of the second embodiment will be described. In this embodiment, first, there is an eccentric shaft. Second, there is a rotor. This rotor has the eccentric shaft concentrically disposed therein. Also, there is a stator. This stator is provided therein with the rotor and is concentric with respect to the eccentric shaft.

Furthermore, there are a plurality of pistons. These pistons are radially disposed within the rotor, and the heads of the pistons are normally contacted with the inner periphery of the stator. And there is working liquid current rectifying means. This working liquid current rectifying means is disposed in such a manner as to contact with a working liquid current inlet and outlet port of the pistons.

The construction of a variable capacity hydraulic piston apparatus of the third embodiment will now be described. In this embodiment, an eccentric shaft is rotatable. Regarding all the remaining construction, the construction is the same as that of the first and the second invention.

Next, the construction of a hydraulic piston apparatus of the fourth embodiment will be described. This embodiment is a hydraulic piston apparatus which comprises an eccentric shaft rotor, a stator having the eccentric shaft rotor eccentrically disposed therein, a plurality of pistons radially disposed within the stator, the heads of the pistons being normally contacted with the outer periphery of the eccentric shaft rotor, and working liquid current rectifying means communicating with a working liquid inlet and outlet port of each of the pistons and including timing detection means such as rotary encoder for detecting the timing for rotation of the eccentric shaft rotor and a change-over valve controlled by the timing detection means.

The construction of a hydraulic piston apparatus of the fifth embodiment will now be described. In this embodiment, first, there is a rotor. Next there are a plurality of eccentric shafts. These eccentric shafts are provided on the rotor. Furthermore, there are a plurality of pistons. Each head of the pistons is normally contacted with the outer periphery of each of the eccentric shafts and piston motion of said head is phasewise split. And there is holding means. This holding means includes a housing, a stator, etc. for holding the pistons. Furthermore, there is working liquid current rectifying means. This working liquid current rectifying means is communicated with a working liquid inlet and outlet port of each of the pistons and includes timing detection means such as rotary encoder for detecting the timing for rotation of the rotor and a changeover valve controlled by the timing detection means.

Next, the construction of a hydraulic piston apparatus of the sixth embodiment will be described. In this embodiment, there is a rotational shaft first. Then, there are a plurality of cylinders. The cylinders are disposed parallel with the rotational shaft. Arrangement is such that piston motion of a piston head disposed within each of the cylinders is phasewise split. And there are a plurality of piston units. These piston units are used for the plurality of cylinders, respectively. Furthermore, there is a cam. This cam is adapted to permit a part of the plurality of piston units to be engaged therewith. The cam is disposed on the rotational shaft. The piston units are caused to effect piston motion in the longitudinal direction of the rotational shaft by rotation of the rotational shaft. Finally, there is working liquid current rectifying means. This working liquid current rectifying means includes timing detection means such as rotary encoder for detecting the timing for rotation of the rotational shaft and a change-over valve controlled by the timing detection means.

Lastly, the construction of a variable capacity hydraulic piston apparatus of the seventh embodiment will be described. In this invention, the timing means includes timing variable means capable of varying the timing control time such as rotary joint or the like.

As a hydraulic piston apparatus according to the present invention is constructed as described above, the following functions are obtained. The function of a hydraulic piston apparatus of the first embodiment will be described first. In this embodiment, the rotor has the eccentric shaft disposed therein, a plurality of pistons are radially disposed within the rotor, and the heads of the pistons are normally contacted with the outer periphery of the eccentric shaft. Accordingly, the piston is actuated at a piston time difference by rotation of the rotor.

And the working liquid current rectifying means is disposed in such a manner as to contact with the working liquid inlet and outlet port of the piston. Accordingly, the working liquid current is rectified here.

Next, the function of a hydraulic piston apparatus of the second embodiment will be described. In this embodiment, the rotor has the eccentric shaft concentrically disposed therein, and the stator is provided therein with the rotor, the plurality of pistons being radially disposed within the rotor, the heads of the pistons being normally contacted with the inner periphery of the stator. Accordingly, these pistons are actuated at a piston time difference by rotation of the rotor.

Furthermore, the working liquid current rectifying means is disposed in such a manner as to contact with the working liquid current inlet and outlet port of the pistons. Accordingly, the working liquid current is rectified here.

The function of a variable capacity hydraulic piston apparatus of the third embodiment will now be described. In this embodiment, the eccentric shaft is rotatable. Accordingly, an intaking and discharging quantity of the working liquid is changed by changing the eccentric angle. Regarding all the remaining functions, the functions are the same as those of the first and the second embodiments.

Next, the function of a hydraulic piston apparatus of the fourth embodiment will be described. In this embodiment, the stator having the eccentric shaft rotor eccentrically disposed therein is provided with the plurality of pistons radially disposed within the stator, and heads of the pistons are normally contacted with the outer periphery of the eccentric shaft rotor. Accordingly, the pistons are actuated at a piston time difference by rotation of the eccentric shaft rotor.

And the working liquid current rectifying means communicating with the working liquid inlet and outlet port of each of the pistons and including timing detection means such as rotary encoder for detecting the timing for rotation of the eccentric shaft rotor and a change-over valve controlled by the timing detection means rectifies the working liquid current the same as working liquid current rectifying means having no sliding portion.

The function of a hydraulic piston apparatus of the fifth embodiment will now be described. In this embodiment, the plurality of eccentric shafts are provided to the rotor, the plurality of pistons being disposed such that each head of the pistons is normally contacted with the outer periphery of each of the eccentric shafts and piston motion of the head is phasewise split, the pistons being held by the holding means. Accordingly, the pistons are actuated at a piston time difference by rotation of the rotor.

And the working liquid current rectifying means is communicated with a working liquid inlet and outlet port of each of the pistons and includes timing detection means such as rotary encoder for detecting the timing for rotation of the rotor and a change-over valve controlled by the timing detection means. Accordingly, the working liquid current is rectified by switching the change-over valve in such a manner as to match the timing with rotation of the rotor.

Next, the function of a hydraulic piston apparatus of the sixth embodiment will be described. In this embodiment, the plurality of cylinders are disposed parallel with the rotational shaft. The arrangement is such that piston motion of a piston head disposed within each of the cylinders is phasewise split. And the plurality of piston units are used for the plurality of cylinder, respectively. Accordingly, there can be obtained phasewise split piston motion. Concretely, the rotational shaft is provided with the cam and this cam is adapted to permit a part of the plurality of piston units to be engaged therewith. The cam is disposed on the rotational shaft. This cam causes the piston units to effect piston motion in the longitudinal direction of the rotational shaft in accordance with rotation of the rotational shaft. Accordingly, a piston motion is effected by this rotation. Finally, the working liquid current rectifying means including the timing detection means such as rotary encoder for detecting the timing for rotation of the rotational shaft and the change-over valve controlled by the timing detection means rectifies the working liquid current from the pistons.

Lastly, the function of a variable capacity hydraulic piston apparatus of the seventh embodiment will be described. In this embodiment, the timing means includes timing variable means capable of varying the timing control time. Accordingly, the intaking and discharging quantity of the working liquid can be varied by this. Regarding all the remaining functions, they are the same as the functions of the fourth and the fifth embodiments, respectively.

BRIEF DESCRIPTION OF THE DRAWINGS

FIG. 8A is a partial sectional elevation view of the apparatus of FIG. 8.

FIG. 8B is a partial sectional elevation view of the apparatus of FIG. 6.

DETAILED DESCRIPTION OF THE EMBODIMENTS

Several embodiments of a hydraulic piston apparatus according to the present invention will be described in detail hereunder with reference to the accompanying drawings.

One embodiment of the invention will be described first in which a rotor is provided with three piston and cylinder assemblies embedded therein at equal 120° distances.

Figure 1:
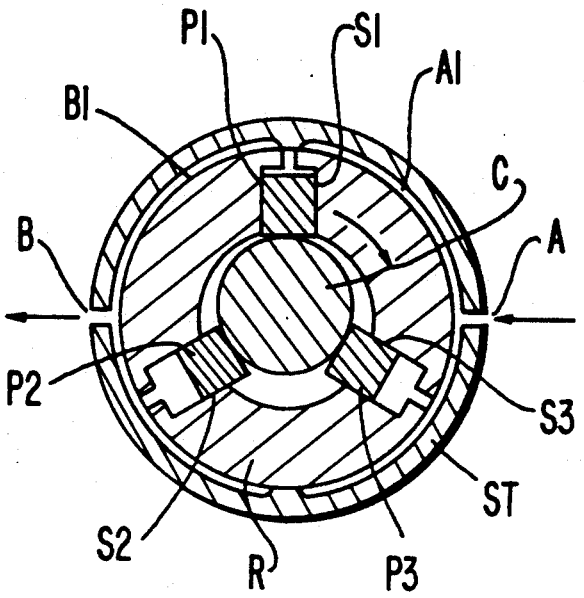
FIG. 1 is a front sectional view of one embodiment of a hydraulic piston apparatus according to the present invention.
Figure 2:
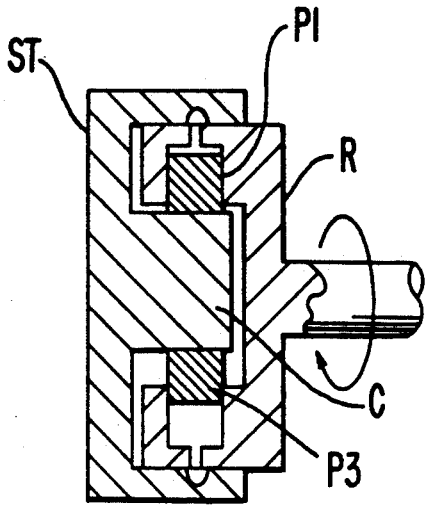
FIG. 2 is a side view of a modified embodiment of FIG. 1.
Figure 3:
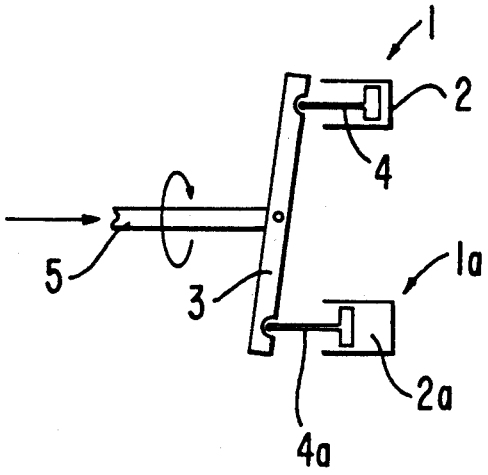
FIG. 3 (PRIOR ART)
FIG. 3 is a side view of one embodiment of the prior art.

FIG. 1 is a front sectional view of the above, and FIG. 2 is a side view thereof. In order to facilitate an easy understanding, in FIG. 2, a first cylinder S is in a position at 0° in the sectional view and a third cylinder S3 is in a position at 270° and therefore three cylinders are provided or embedded.

The stator ST and a cam C acting as an eccentric shaft are fixed. When the rotor R is rotated clockwise, the piston P1 is moved toward the center of the rotor R along the cam C in an initial stage of its rotation in FIG. 1. Therefore, it intakes working liquid from a port A (in the drawing, a spring for urging the piston P against the rotor R is omitted. The same is true hereinafter). Similarly, the piston P3 intakes the working liquid from the port A. On the other hand, the piston 2 is moved outward to discharge the working liquid to a port B.

Figure 4:
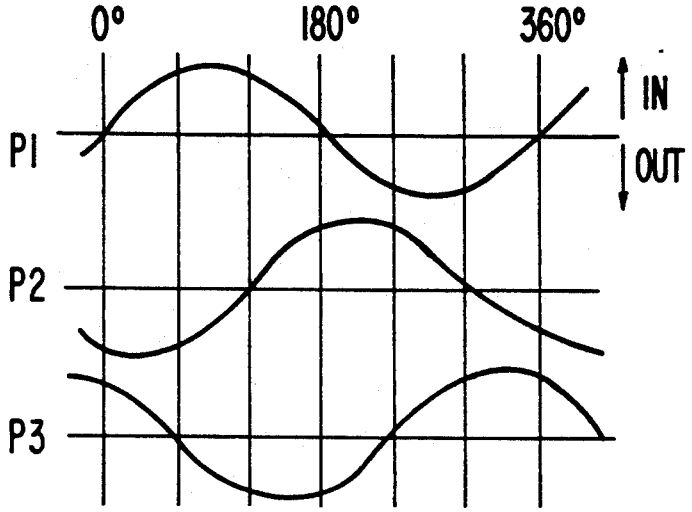
FIG. 4 is a chart showing a relation between intaking and discharging quantities of working liquid of the embodiment of FIG. 1 into and from each piston over time.

FIG. 4 shows a chart showing a relation between the working liquid intaken or discharged and strokes of the pistons P1 through P3 when the rotor R is rotated clockwise and presuming the position of the piston P1 of FIG. 1 is 0°. The waveforms shown in FIG. 4 are obtained when the configuration of the cam C is determined such the action of the pistons P resemble a sine waveform every time the rotor R makes one full rotation.

Figure 5:
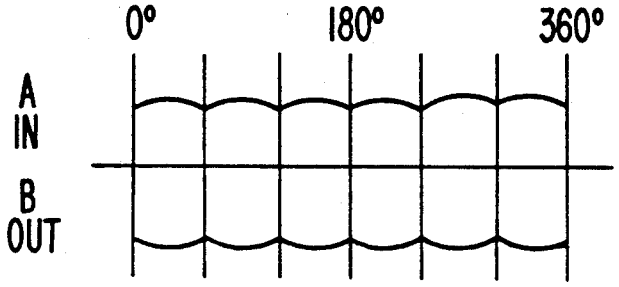
FIG. 5 is an illustration of the combined effect of flow at each port in the relation of FIG. 4.

Each piston P, as shown in FIG. 4, repeats intaking and discharging operation in a state displaced phasewise by 120° from the operation of the other pistons. However, if viewed per each port, grooves A1 and B1 act as current rectifiers. Therefore, if the intaking and discharging states of the working liquid of the respective pistons P are combined, the port A keeps intaking the working liquid and the other port B keeps discharging the working liquid as shown in FIG. 5.

The grooves A1 and B1 do the same work as the cam plate type pump. If the rotating direction of the rotor R is reversed, the port A discharges the working liquid and the port B intakes it. If the stroke of the piston P is represented by D and the diameter by d, the discharge capacity and intake capacity per one full rotation of the rotational shaft becomes $3D\pi d^2/4$ in the case of three pistons P.

In this case, sealing of the grooves A1 and B1 for performing a current rectifying function becomes very difficult because of the presence of a space between the rotor R and the stator ST. Therefore, in order to reduce the dimension of this space, the following method is contemplated.

Figure 6:
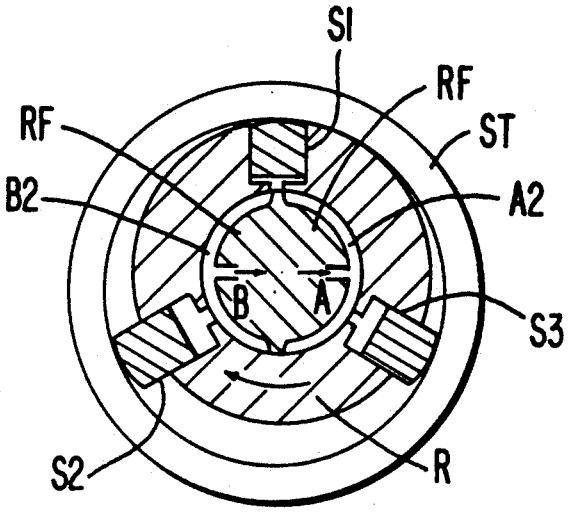
FIG. 6 is a front sectional view of one form of another embodiment.

In FIG. 6 showing one form of the second embodiment, a current rectifying shaft RF is disposed in an interior of the rotor R and has current rectifying grooves A2 and B2 formed in its outer surface. Each of the current rectifying grooves A2 and B2 is provided with a port. If the center of the stator ST is displaced from the centers of the rotor R and current rectifying shaft RF, the apparatus works quite in the same way as that of FIG. 1. Although the sealing between the rotor R and the current rectifying shaft RF becomes much easier because the dimension of the space formed therebetween is smaller than in the earlier described embodiment, the sliding portion is not eliminated.

Figure 7:
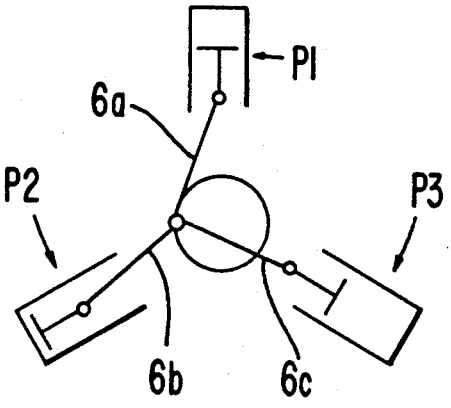
FIG. 7 (PRIOR ART)
FIG. 7 is an explanatory view of one embodiment of a conventional piston arrangement.

As is shown in FIG. 7, the situation is quite the same as in a structure formed of a combination of the pistons P1 through P3 with cranks 6*a* through 6*c* radially disposed around the crankshaft. That is, in a mechanism for rectifying an alternating current according to reciprocal motion of the piston P, it is necessary to rotate the current rectifying plate strictly in synchronism with the crankshaft. Although there is a type of device for effecting the rotation in accordance with the opening and closing operation of the valve as in an internal combustion engine like a gasoline engine, the present inventor does not know any example where this is used in a working liquid pressure pump, a fluid motor, etc. It seems to him that the problem of internal leakage due to enormous working liquid pressure is again the problem.

In the above mentioned type of a working liquid current rectifying structure, the problem of working liquid leakage is always present. Furthermore, in order to make the apparatus variable capacity, the conventional pump and motor are all formed in a structure in which stroke of the piston P is variable.

In the first mentioned structure of FIGS. 1 and 2, variable capacity can be obtained by controlling the amount of displacement of the cam C. However, as the cam C receives the pressure of the piston P directly, a simple structure and an improved strength are required in order to increase reliability. Therefore, in order to control the amount of displacement of the cam C, a large-scale mechanism is needed and the initial object is impossible to achieve. Moreover, this is no use at all for solving the problem of working liquid leakage of the current rectifying mechanism.

There will next be described a method for making the capacity variable while maintaining a constant stroke.

Figure 8:
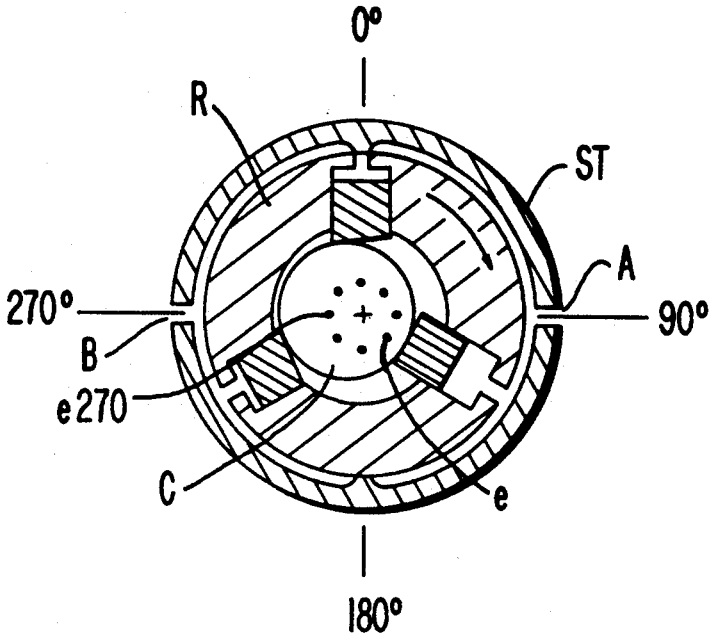
FIG. 8 is a front sectional view of one embodiment of a variable capacity type hydraulic piston apparatus according to the invention.

In the structure of FIG. 8, the cam C has been displaced around rotational axis X from the FIG. 1 position through a locus of eccentric positions e to a position e270: A fixing means FM is connected to cam drive shaft CD rotatable around axis X for moving cam C and fixing it at one of the eccentric positions e. The rotor R is rotated clockwise as in one form of the third embodiment shown in FIG. 8, and the piston P1 intakes the working liquid within the arc of rotation from 0° to 90° and discharges the working liquid within the arc from 90° to 180°. Moreover, the intaking and discharging rates are equal. And it discharges the working liquid within the arc from 180° to 270° and intakes it within the arc from 270° to 0°. Thus, both are equal. Therefore, the balance of the intaken working liquid and the discharged working liquid becomes zero. The same is true for the port B. The rotor R is merely rotated idle and the discharging rate becomes zero. Of course, the ripple portion exists as in FIG. 5, but in case of three cylinders, the ripple portion is relatively low amplitude. Therefore, the ripple portion which appears in the outside piping is greatly reduced. Furthermore, if the number of the cylinders is increased, the ripple portion is further decreased. However, thoughtless employment of a large number of cylinders is not advantageous in view of loss of strength. From a practical view point, approximately three to nine cylinders are proper.

Instead of the cam C of FIG. 8 being movable along the locus of positions e, the stator ST of the embodiment of FIG. 6 can be made movable in this manner, while the cam RF is fixed, and a fixing means FM is provided for fixing the stator ST at one of the locus of eccentric positions, as shown in FIG. 8B.

Figure 9:
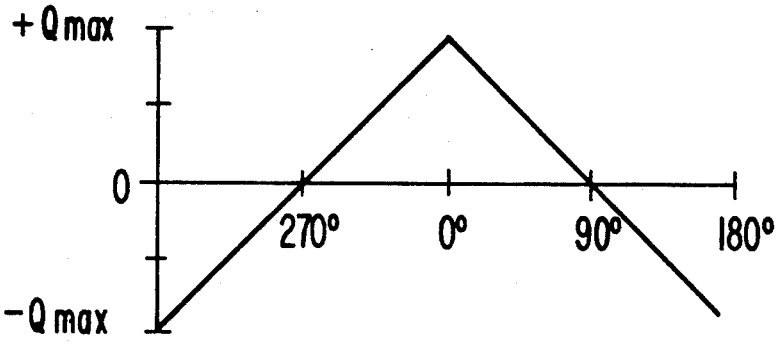
FIG. 9 is a comparison chart of the angle of rotation of a cam of the embodiment of FIG. 8 and an average discharging rate of working liquid.

The quantity of discharge Q of the pump, as shown in FIG. 9, becomes maximum when the eccentric position of the cam C of FIG. 8 or stator ST of FIG. 8B is 0°. The quantity Q is decreased when the cam C or stator ST is moved either clockwise or counterclockwise. When in a position of 90° or 270°, it becomes Q=0. When it is further moved, he direction of flow Q is reversed this time and it becomes $-Q_{max}$ when in a position of 180°. From this, it will be understood that the direction of discharge can be reversed without changing the rotating direction of the rotor R. That is, this means that a two-way type variable capacity pump can be provided by a pump apparatus moving only in unidirectional rotation. Moreover, in this case, the cam C or stator ST can be moved with a very simple mechanism and the vicinity of the cam C has nothing to do with the working liquid leakage and is thus convenient.

Next, it is necessary to solve the problem of sealing at the current rectifying portion.

At the time when the current is rectified, if there is a sliding portion, it means that leakage of the working liquid is generated at that portion. Therefore, it is ideal to omit the sliding portion, if possible. Of course, parts such as rotary joints, etc. are commercially available, but they also have a sliding portion and thus require mechanical sealing.

Figure 10:
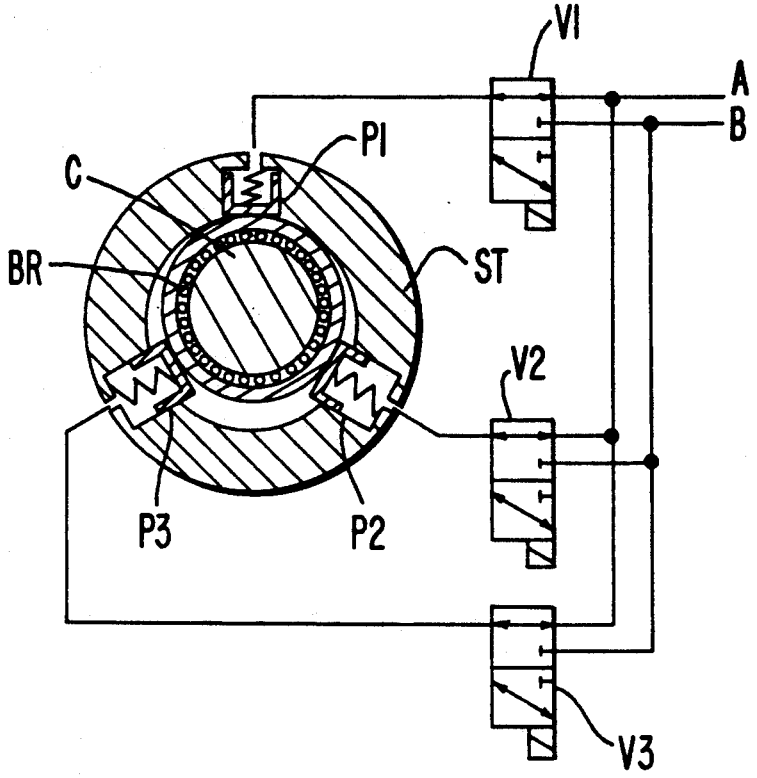
FIG. 10 is a front sectional view of one form of still another embodiment.

In view of the above, the inventor of the present invention has developed an apparatus as shown in FIG. 10 which is one form of the fourth embodiment. The flow for piston P1 is changed over by being connected to a port A or a port B with a three-port two-position electromagnetic valve V1. Other pistons P2 and P3 are also connected to the port A or B through three-port two-position electromagnetic change-over valves V2 and V3 respectively.

When the cam C integral with the input shaft is rotated, the pistons P1 through P3 are reciprocally moved in association with the rotation of the cam C to cause the working liquid to be intaken to and discharged from the respective cylinder chambers. If a bearing Br is provided between cam C and the shaft, as shown in FIG. 10, the engaging portion between the piston P and the cam C is not slidingly moved. Accordingly, there is no worry about friction and wear.

Springs (unnumbered) are provided in the cylinder chambers of the respective pistons P1 through P3 so that the pistons P are normally urged against the cam C. However, if a base pressure is preliminarily applied to the whole working liquid pressure circuit, the pistons P are normally urged against the cam C due to the base pressure. In this case, therefore, springs are not required.

Figure 11A:
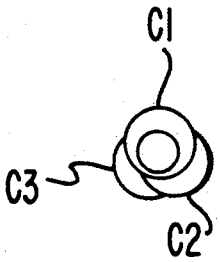
FIG. 11 is one example of an embodiment in which pistons are linearly arranged, FIG. 11*a* being a front view of a cam portion thereof, and FIG. 11*b* being a side sectional view.
Figure 11B:
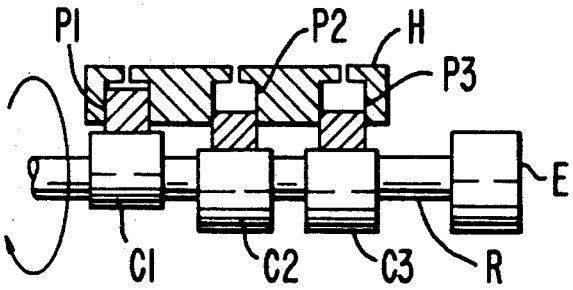
Figure 12A:
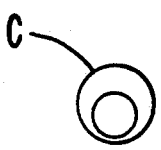
FIG. 12 is an illustration of an embodiment with the pistons P radially arranged, FIG. 12*a* being a front view of a portion of cams C1 through C3, and FIG. 12*b* being a side sectional view of the entire embodiment.
Figure 12B:
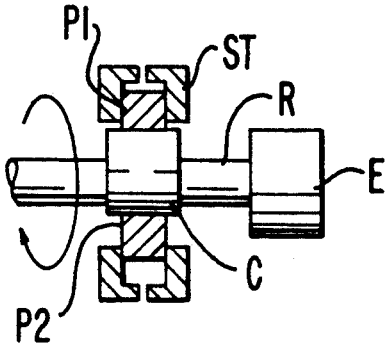

Furthermore, as is shown in FIGS. 11*a* and 11*b* showing one form of the fifth and the seventh embodiments, a rotary encoder E shown in FIG. 11*b* is mounted on the shaft in order to detect the angle of rotation of the input shaft. The parts of FIG. 11 show one example wherein the pistons P are linearly arranged, FIG. 11*a* being a front view of the cam C portion thereof, and FIG. 11*b* being a side sectional view of the entire apparatus. FIGS. 12*a* and 12*b* show another embodiment wherein the pistons P are radially arranged, FIG. 12*a* being a front view of the cams C 1 through 3 portions, and FIG. 12*b* being a side sectional view of the entire apparatus. In order to simplify the drawing, the number of the pistons is an even number.

There can be contemplated a combination of the FIG. 11 and FIG. 12 type apparatus. That is, instead of providing radial type pistons arranged in a multiplex manner or providing radial type pistons in the same plane (although it becomes large), the pistons are arranged in the longitudinal direction of the rotor R. Owing to the foregoing arrangement, the number of pistons can be unlimitedly increased in a multiplex radial type apparatus.

Figure 13:
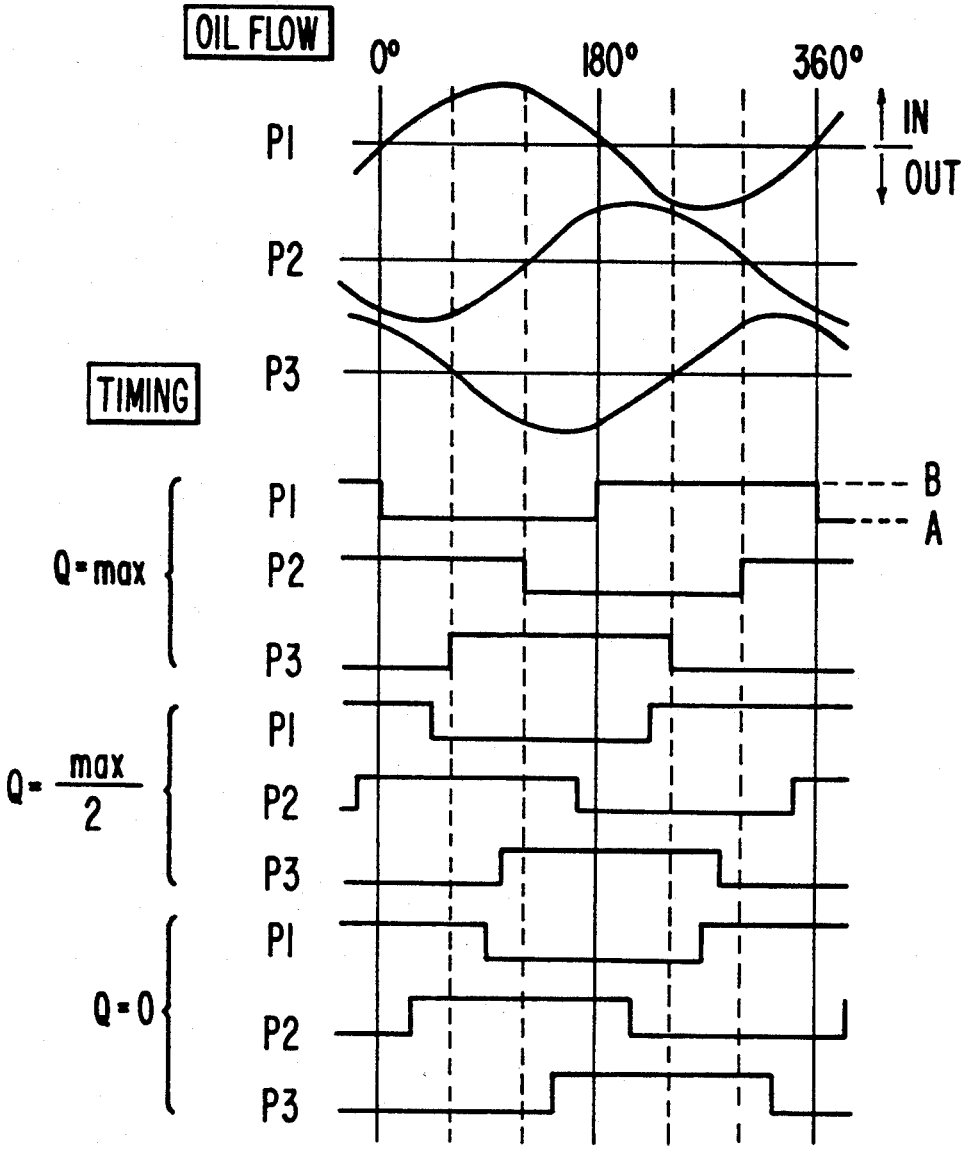
FIG. 13 is a chart showing the change-over timing of three port valves for intaking and discharging working liquid in a cylinder chamber of the embodiment of FIG. 10.

As is shown in FIG. 10, if the three-port two-position electromagnetic change-over valve V1 is connected to the port A from the time when the cam C is fixed in the direction of 0° and the piston P1 is pushed up to the top dead point until the cam C is rotated clockwise to the position where the cam is in the direction of 180°, i.e., during a movement from 0° to 180°, the working liquid is intaken through the port A. During the next section of from 180° to 360°, the valve V1 is switched to the port B and the working liquid is discharged through the port B. This state is depicted in FIG. 13 showing the incoming and outgoing state of the working liquid to and from the cylinder chamber and the switching timing of the three-port valve.

Similarly, the piston P2 is switched while it is in the state where the phase is delayed by 120° and the piston P3 is switched while in a further delayed state by 120°. This is quite the same function as that of the current rectifying grooves A1 and B1 shown in FIG. 1 and the discharging quantity Q=max. Likewise, if the switching timing of all three-port valves V1 through V3 is delayed by 45°, Q becomes a half of the max. If it is further delayed by 45°, Q=0. Therefore, by delaying the switching timing of the three-port valve in accordance with the angle information from the rotary encoder, the same effect can be obtained as that which can be obtained by rotating the angle of the eccentric cam C of FIG. 2.

In the above embodiment, the rotary encoder E is used in order to detect the angle of rotation of the input shaft (eccentric cam C). It is to be noted that the type of the encoder is not limited and it may be an optical type, a magnetic type or a mechanical type as long as it can detect the angle with high accuracy.

In the foregoing, a method for electrically switching the ports was described. One example for performing the same procedure by a mechanical method will be described next.

Figure 14:
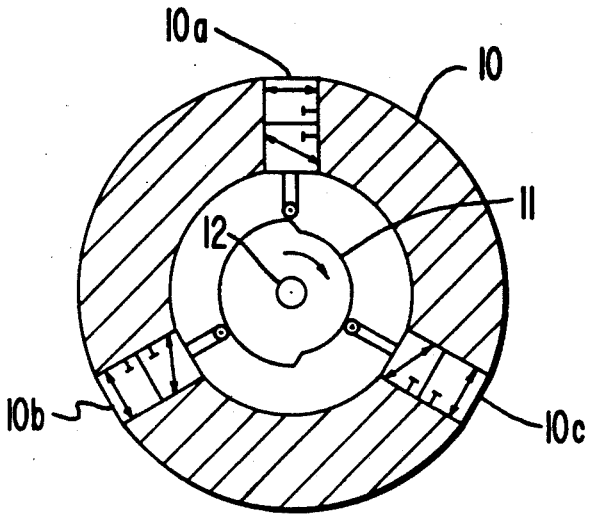
FIG. 14 is a front sectional view showing a tracer valve and a change-over cam according to another embodiment of FIG. 10.

As is shown in FIG. 14, three-port tracer valves 10*a*, 10*b* and 10*c* are equally radially arranged on a rotatable ring 10 and the rotational shaft 12 connected to the rotor R of the pump of FIG. 10 is provided with a change-over cam 11 (having a configuration causing each valve to be switched every 180° of rotation) for controlling the valves 10*a*, 10*b* and 10*c*. And by rotating the ring 10 rightward and leftward through a desired angle, the switching timing of the rectifying action can be adjusted in the same manner as mentioned in the preceding paragraph. By this means, the pump can be made a variable capacity type.

Figure 15:
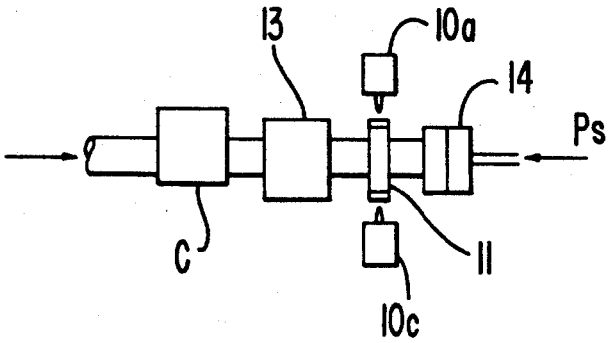
FIG. 15 is a side view showing a tracer valve and a change-over cam according to still another embodiment of FIG. 10.
Figure 16:
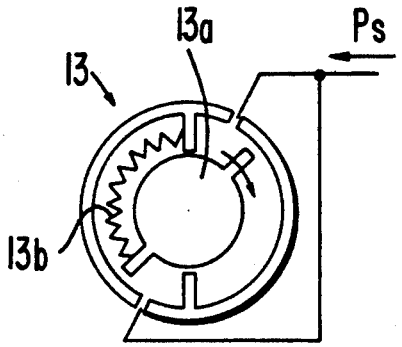
FIG. 16 is a front sectional view of one embodiment of a swing motor of FIG. 15.

This ring 10 can also be used to make the pump into a two-way discharging variable capacity type pump by means of rotation by ±90° from a position of 90° or 270° while maintaining the unidirectional rotation of the rotational shaft 12. If it is desired not to rotate the tracer valves 10*a*, 10*b* and 10*c*, the same effect can be obtained by shifting the phase of the change-over cam 11 with respect to the eccentric cam C for driving the pistons P. A concrete example of this, as shown in FIG. 15, is designed such that a swinging motor 13 is interposed between the cam C and the change-over cam 1;, and a working liquid under pressure $P_s$ is applied through the center of the rotational shaft 12 from an external means via the rotary joint 14 to motor 13. As the swinging motor 13 has a shaft 13*a* which is rotated to an angle where the internal spring 13*b* and working liquid pressure $P_s$ are balanced, the phase of the change-over cam 11 can easily be controlled only by the working liquid pressure.

A counter measure for a time delay required for switching will now be described.

In recent times, it has become possible to vary the speed of rotation of an electric motor at a low cost by inverter driving. If the capacity of a pump can be varied and the speed of rotation can be varied, control accuracy can be improved in the vicinity of microcapacity $A_{min}$.

In this case, control disadvantages occur. That is, it takes a certain time from the time when the angle of rotation of the rotational shaft 12 is detected until the time when controlling of the current rectifying valve is finished. The reason for this is as follows. If the speed of rotation of the rotational shaft 12 is varied, the time required for the rotational shaft 12 to make one full rotation is varied. However, if the delay time $\tau$ of rectifying current is constant, the switching phase is greatly displaced in proportion to the speed of rotation.

This situation will be understood from the following expression.

That is, $$x = \frac{\tau}{60/v} \cdot 2\pi$$

wherein x is phase correcting value, v is a speed of rotation RPM, $\pi$ is 180°, and $\tau$ is delay time in seconds.

If V=1500 RPM and the current rectifying time is $\tau$=0.01 sec, the following relation can be obtained.

$$\frac{0.01}{60/1500} \cdot 2\pi = \pi/2$$

Figure 17:
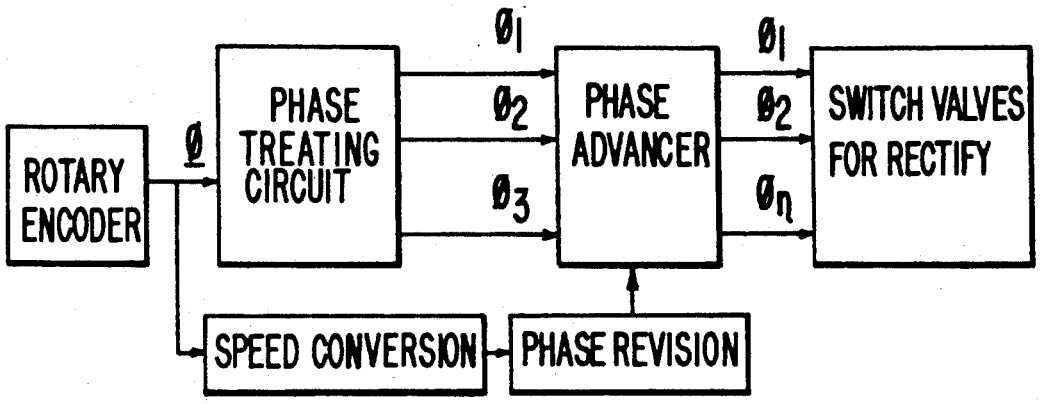
FIG. 17 is a block diagram of an embodiment showing a countermeasure for time delay required for change-over.

Thus the phase is displaced by as much as 90°. By displacing the phase by 90°, the capacity is varied from Q=max to Q=0. Therefore, if an error as great as 90° takes place, it becomes impossible to use the pump. Therefore, as is shown in FIG. 17, a correct angle position of the shaft is detected by a signal $\phi$ from the rotary encoder, phase shifting is sequentially performed at the rate of 360°/n wherein n represents the number of cylinders and signals of $\phi_1, \phi_2 \ldots \phi_n$ are produced in a phase processing circuit.

Then, they are converted to speed signals by a speed converting circuit and a phase correcting calculation is performed in accordance with the above relation to figure out a corrected phase angle x and then, n signals $\phi$ are advanced in parallel in phase by a phase advancing circuit. By such phase advanced signals $\phi_1', \phi_2' \ldots \phi_n'$, n current rectifying change-over valves are controlled. If correction is performed in this way, the pump is normally operated.

Although three-cylinders are employed in the above examples other than the last one, three to nine cylinders in a radial arrangement in one stage can be considered for a practical use. In that case, if the number of cylinders is represented by n, the cylinders are equally dividedly arranged angles of 360°/n and the phase correction can be performed at that ratio. Although the function as a pump is described, in case of a working liquid pressure pump, it can be changed to a liquid pressure motor quickly. Even in this system, there is no inconvenience in function as a liquid pressure motor. Therefore, all of the above description applied to a liquid pressure two-way variable capacity pump can be applied to a two-way variable capacity motor.

Figure 18:
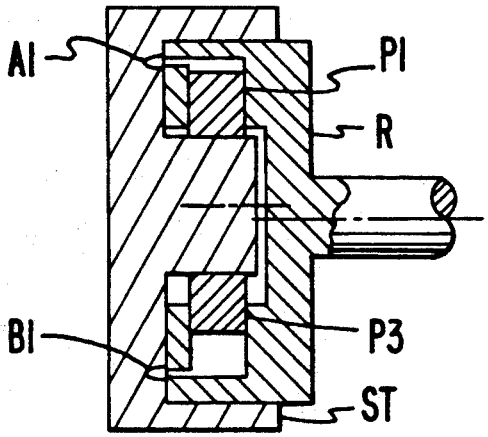
FIG. 18 is a side sectional view of another embodiment of the apparatus of the invention.
Figure 19:
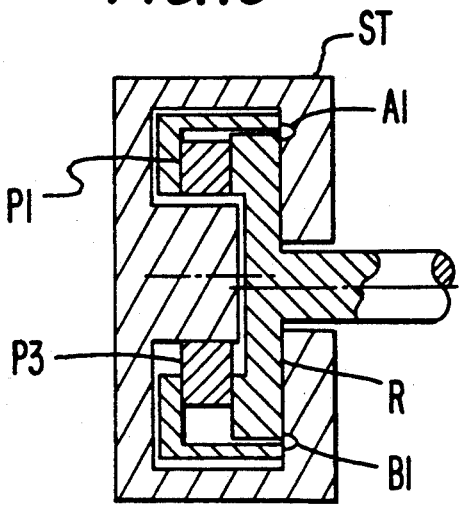
FIG. 19 is a side sectional view of still another embodiment of the apparatus of the invention.

The current rectifying grooves A1 and B1 shown in FIG. 1 may be opposed to the side of the stator ST as shown in FIG. 18. This can also be done as shown in FIG. 19.

Although it has been shown in FIG. 17 that the signal $\phi$ from the rotation detecting means is converted to a speed signal, the system can be designed such that a rotation speed detector other than an angle detector is mounted on the shaft and the advance phase circuit is controlled based on the signal therefrom.

Figure 20:
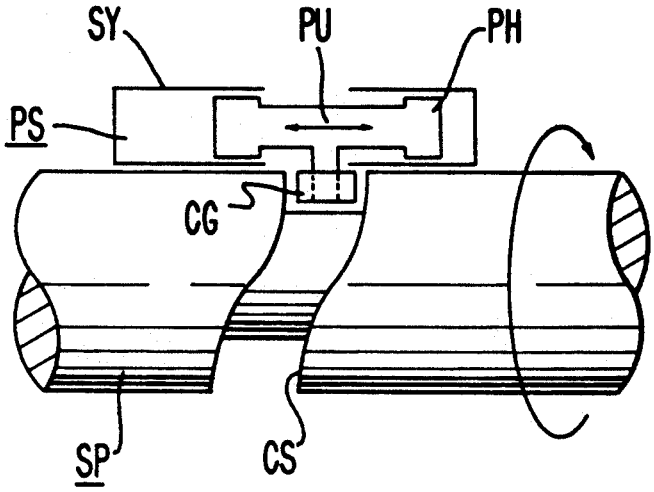
FIG. 20 is a side view showing the construction of a hydraulic piston apparatus according to still another embodiment and in which a part of its pistons is omitted.
Figure 21:
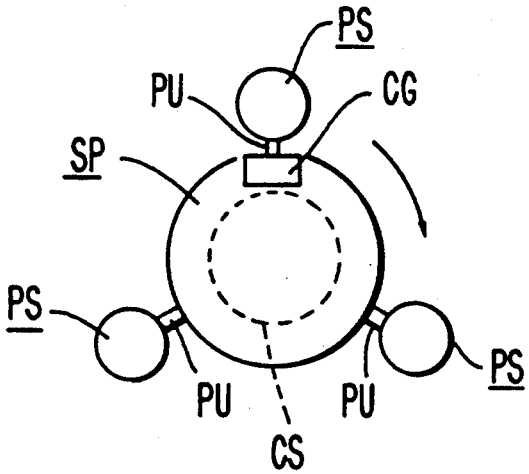
FIG. 21 is a front view o the embodiment of FIG. 20.

Lastly, one form of the construction of a hydraulic piston apparatus of the sixth embodiment will be described with reference to the side view of FIG. 20 and the front view of FIG. 21. In FIG. 20, two pistons are omitted for simplicity of the drawing.

First, there is a rotational shaft SP, and piston units PS disposed in parallel relation with the rotational shaft SP and spaced therearound. A plurality of pairs of cylinders SY are spaced around the shaft with their open ends opposed. The plurality of pairs of cylinders SY receive piston heads PH on the opposite ends of pistons PU. As shown, three piston units PS are arranged at angles of 120° in this embodiment as shown in FIG. 21. The pistons PU in each unit are caused to perform a piston motion displaced in phase from the pistons in the other units by 120°.

Furthermore, the rotational shaft SP is provided with a cam groove CS. This cam groove CS has a shape of a continuous letter S. Engaged in this cam groove CS are cam groove followers CG attached to corresponding piston units PU. The cam groove CS is shaped to cause the respective pistons PU to effect a piston motion in accordance with the rotation of the rotational shaft SP.

This embodiment should also be provided with a working liquid current rectifying means. Although this working liquid current rectifying means is not illustrated, it can be like that of FIG. 4 or that of FIG. 5, and comprise timing detecting means such as a rotary encoder, etc., for detecting the timing of the rotation of the rotational shaft, and change-over valves controlled by the timing detecting means.

The hydraulic piston apparatus according to the present invention is constructed as described above, and the effects as described above for each embodiment can be achieved. Particularly, it is a hydraulic piston apparatus which is very simple in construction and which has a long service life. Furthermore, the third and seventh embodiments are easily constructed to provide a variable capacity type hydraulic piston apparatus.

What is claimed is:

1. A variable capacity hydraulic constant stroke piston apparatus comprising:

an annular rotor rotatably mounted for rotation around an axis of rotation and having a plurality of radial cylinder bores therein spaced at intervals around said rotor, said cylinder bores having working liquid inlet and outlet means at the radially outer ends thereof;

rotor drive means connected to said rotor for rotating said rotor around said axis of rotation;

an eccentric dam positioned within said rotor and movable along a circular locus of eccentric positions, said circular locus being concentric with said axis of rotation;

means fixing said eccentric cam within said rotor at one of said plurality of eccentric positions and for moving said eccentric cam around said axis of rotation between said positions;

a plurality of pistons radially reciprocally movably mounted in corresponding cylinder bores in said rotor, said pistons having heads normally contacting an outer periphery of said eccentric cam and moving through a constant length stroke at each position of said cam; and working liquid current rectifying means connected between said inlet and outlet means of said cylinder bores and an inlet and outlet from said apparatus for supplying working liquid to said cylinders and receiving working liquid from said cylinders in a reciprocating flow and rectifying and smoothing said flow at the inlet and outlet of said apparatus.

2. A hydraulic piston apparatus as claimed in claim 1 further comprising a stator concentrically mounted in a fixed positon around said rotor, said stator having said inlet and outlet from said apparatus therein spaced around said rotor, and said working liquid current rectifying means comprises passage means along said stator from positions around the interior of said stator to said inlet and outlet from said apparatus.

3. A variable capacity hydraulic constant stroke piston apparatus comprising:

an annular rotor rotatably mounted for rotation around an axis of rotation and having a plurality of radial cylinder bores therein spaced at intervals around said rotor, said cylinder bores having working liquid inlet and outlet means at the radially inner ends thereof:

rotor drive means connected to said rotor for rotating said rotor around said axis of rotation;

a fixed shaft positioned concentrically within said rotor;

an eccentric stator mounted around said rotor and movable along a circular locus of eccentric positions, said circular locus being concentric with said axis of rotation;

means fixing said stator around said rotor at one of said plurality of eccentric positions and for moving said stator around said axis of rotation between said positions;

a plurality of pistons radially reciprocally movably mounted in corresponding cylinder bores in said rotor, said pistons having heads normally contacting an inner periphery of said stator and moving through a constant length stroke at each position of said stator; and working liquid current rectifying means connected between said inlet and outlet means of said cylinder bores and an inlet and outlet from said apparatus for supplying working liquid to said cylinders and receiving working liquid from said cylinders in a reciprocating flow and rectifying and smoothing said flow at the inlet and outlet of said apparatus.

4. A hydraulic piston apparatus as claimed in claim 3 in which said working liquid current rectifying means comprises passages along said fixed shaft from positions around the interior of said rotor to the inlet and outlet from said apparatus.

* * * * *